US008544252B2

(12) United States Patent
Tao et al.

(10) Patent No.: US 8,544,252 B2
(45) Date of Patent: Oct. 1, 2013

(54) METHOD AND APPARATUS FOR REDUCING RESIDUAL TORQUE AND NEPS IN SINGLES RING YARNS

(75) Inventors: Xiaoming Tao, Hong Kong (CN); Tao Hua, Hong Kong (CN); Bingang Xu, Hong Kong (CN); Jie Feng, Hong Kong (CN)

(73) Assignee: The Hong Kong Polytechnic University, Hong Kong (CN)

( * ) Notice: Subject to any disclaimer, the term of this patent is extended or adjusted under 35 U.S.C. 154(b) by 0 days.

(21) Appl. No.: 13/343,723

(22) Filed: Jan. 5, 2012

(65) Prior Publication Data

US 2012/0151894 A1 Jun. 21, 2012

Related U.S. Application Data

(63) Continuation-in-part of application No. 12/222,133, filed on Aug. 4, 2008, now abandoned.

(51) Int. Cl.
*D01H 7/52* (2006.01)

(52) U.S. Cl.
USPC ..... 57/75; 57/336

(58) Field of Classification Search
USPC ..... 57/75, 336
See application file for complete search history.

(56) References Cited

U.S. PATENT DOCUMENTS

| | | | | | |
|---|---|---|---|---|---|
| 2,590,374 | A | * | 3/1952 | Brown | 57/336 |
| 2,908,133 | A | * | 10/1959 | Brown | 57/336 |
| 3,045,416 | A | * | 7/1962 | Ubbelohde | 57/334 |
| 3,103,097 | A | * | 9/1963 | Meili et al. | 57/336 |
| 3,228,181 | A | * | 1/1966 | Paterson | 57/293 |
| 3,813,868 | A | * | 6/1974 | Lorenz | 57/336 |
| 3,979,894 | A | * | 9/1976 | Takai | 57/336 |
| 4,174,605 | A | * | 11/1979 | Pallay | 57/403 |
| 4,566,265 | A | * | 1/1986 | Naylor | 57/336 |
| 4,698,959 | A | * | 10/1987 | Schippers et al. | 57/336 |
| 4,852,341 | A | * | 8/1989 | Kato et al. | 57/328 |
| 4,917,660 | A | * | 4/1990 | Spaller et al. | 493/42 |
| 4,959,952 | A | * | 10/1990 | Kato et al. | 57/261 |
| 5,848,524 | A | * | 12/1998 | Lappage et al. | 57/315 |
| 5,966,918 | A | * | 10/1999 | Kino et al. | 57/264 |
| 5,983,619 | A | * | 11/1999 | Tone | 57/264 |
| 6,032,451 | A | * | 3/2000 | Dinkelmann et al. | 57/315 |
| 6,199,361 | B1 | * | 3/2001 | Yakushi et al. | 57/332 |

(Continued)

FOREIGN PATENT DOCUMENTS

| | | | |
|---|---|---|---|
| CN | 101967706 | A | 2/2011 |
| CN | 201809520 | U | 4/2011 |

(Continued)

*Primary Examiner* — Shaun R Hurley
(74) *Attorney, Agent, or Firm* — Duane Morris LLP; Siegfried J. W. Ruppert

(57) ABSTRACT

Method and apparatus for reducing residual torque in singles ring yarns, achieved by imparting two separate false twisting points on the traveling strand of fibers (or yarn) after the strand exits from the spinning triangle with a proper ratio between the belt speed and the strand feeding speed. In addition to reducing the residual torque, this double false twist technique also reduces yarn hairiness to the same level as achieved by more expensive compact spinning devices, reduces yarn twist by more than 20% and significantly enhances yarn and fabric softness. Furthermore, by combining the double false twist technique with a compact spinning device, the numbers of neps, thick and thin places are significantly reduced to produce high-quality yarns and fine-count yarns.

18 Claims, 17 Drawing Sheets

(56) References Cited

U.S. PATENT DOCUMENTS

| | | | | |
|---|---|---|---|---|
| 6,318,060 | B1 * | 11/2001 | Dinkelmann et al. | 57/3 |
| 7,096,655 | B2 * | 8/2006 | Tao et al. | 57/75 |
| 7,841,161 | B2 | 11/2010 | Cheng et al. | |
| 2005/0268591 | A1 * | 12/2005 | Tao et al. | 57/75 |

FOREIGN PATENT DOCUMENTS

| | | | |
|---|---|---|---|
| CN | 201809521 | U | 4/2011 |
| CN | 101967707 | A | 5/2011 |
| CN | 102071499 | A | 5/2011 |
| WO | 9732064 | A1 | 9/1997 |

* cited by examiner

METHOD AND APPARATUS FOR REDUCING RESIDUAL TORQUE AND NEPS IN SINGLES RING YARNS

CROSS-REFERENCE TO RELATED APPLICATION

This application is a continuation-in-part (CIP) application of patent application Ser. No. 12/222,133, filed on Aug. 4, 2008, now abandoned, the disclosure of which is incorporated herein by reference in its entirety for all purposes.

FIELD OF THE INVENTION

The present invention relates to spinning technology for the production of a singles ring yarn. The invention is particularly concerned with a method and apparatus that utilize a false twist device with two false twisting points to yarns between double belts and incorporate them in the conventional ring spinning machine to improve yarn properties and fabric performance as well as the efficiency of false twist and ease of operation. The false twist efficiency for yarn and thus the property of the final singles ring yarn can be controlled, resulting in yarns with reduced residual torque and twist. This invention further relates to a solution to problems of yarn appearance deterioration peculiar to yarns produced using the double false twisting techniques of the present invention. This solution is particularly necessary for producing finer yarns count as well as yarns for high-quality products.

BACKGROUND OF THE INVENTION

Twisting is an important step of short fiber spinning. In this process, the yarns are twisted and transformed to attain sufficient strength, wear resistance and smoothness. However, as a negative effect, a large amount of residual torque or twist liveliness is also brought about in the yarns simultaneously. Such twist liveliness of the yarns significantly influences the quality of the resulting products. For example, if yarns with twist liveliness are used for knitting, loops of the fabric will lose their balance because of the residual torque in the yarns. In order to attain the natural structure with the minimum energy condition, the loops tend to rotate to release the internal torsion stress. As a result, one end of the loops will tilt and protrude from the fabric surface, while the other end will stay inside the fabric. Such deformation of the loops will increase the spirality of the fabric, i.e., a deformation similar to the rib effect, which should be prevented to the greatest extent possible. Thus, the balancing of torque inside the yarns is particularly important.

Staple yarns are made from a large quantity of fibers bonded by the friction between the fibers. Hence, the residual torque of the yarns or the spirality of the fabric is mainly affected by the friction-related characteristics of the fibers, such as the type and cross-sectional shape of the fibers, the polymerizing manner of the fibers and the internal structure of the yarns, etc.

First of all, different types of fibers have a different modulus and cross sectional shape, thus leading to different degree of stress in the yarns. In cotton/polyester blended yarns, increasing the ratio of polyester will enhance the twist liveliness of rotor and ring yarns, but heat setting can improve the spirality of the resultant fabrics.

This is because polyester has a higher modulus than cotton, and said two types of fiber have different cross sectional shapes.

Next, different yarn structures have a different distribution of stress. Experimental results, such as Barella and Manich in the Textile Research Journal, Vol. 59, No. 12, 1989, Lord and Mohamed in the Textile Research Journal, Vol. 44, No. 7, 1974 and Sengupta, and Sreenivasa in the Textile Research Journal, Vol. 64, No 10, 1994 showed that, friction spun yarns (DREF-II) have the largest residual torque and trend of deformation in the priority sequence followed by ring yarns, rotor yarns and air-jet yarns. It is generally agreed that singles ring yarns are composed of a plurality of uniformly enveloped concentric helical threads, while fiber migration is a secondary feature. Hence, when the ring yarns are reverse-twisted, their strength will gradually decreases to zero, by then the yarns will be all dispersed. In relation to ring yarns, unconventional spinning systems produce yarns with core-sheath structures, such as rotor spinning yarn, air jet spinning yarn and friction spinning yarns. The packing density of said yarns is uneven and mainly characterized by partial entanglement and entrapment of the fibers.

In addition, many factors can affect the degree of movement freedom of the loops of the fabric and also the final spirality of the fabric. Said factors include fabric structure, parameters of the knitting machine, and the fabric relaxation and fabric setting due to finishing. All the aforesaid factors affecting the spirality of fabric were reported in detail by Lau and Tao in the Textile Asia, Vol. XXVI, No. 8, 1995. As with other materials, the residual torque of the yarns can be reduced or eliminated using different methods. In the past several decades, a variety of torque balancing methods have been developed. According to the basic theory, they can generally be split into two categories: permanent processing methods and physical torque balancing methods.

Permanent setting methods mainly accomplish the purpose of releasing residual torque by transforming the elastic torsional deformation into plastic deformation. The method mainly relates to a variety of setting techniques for material, such as thermal setting, chemical processing and wet setting etc. In the Textile Research Journal, Vol. 59, No. 6, 1989, Araujo and Smith have proved that for air-jet and rotor yarns, the heat setting of singles cotton/polyester blended yarns can effectively reduce the residual torque of the yarn. However, in relation to natural fibers such as cotton or wool, permanent setting is more complicated. It may involve steaming, hot water and chemical processing (such as mercerization in the case of cotton yarns and treatment with sodium bisulphite in the case of the wool yarns). In addition, in relation to natural yarns, setting cannot completely eliminate the residual torque of the singles yarns, and may also cause damage to the yarns.

Compared with permanent processing, physical torque balancing is a purely mechanical processing technique. The main point of the method is to fully utilize the structure of the yarns to balance the residual torque generated in different yarns while maintaining the elastic deformation characteristic of the yarns. Currently in the industry, separate machines are required to achieve torque balancing of the yarns, hence the cost is higher. The method comprises plying two identical singles yarns with a twist equal in magnitude but in the opposite direction or feeding two singles yarns with twist of the same magnitude but in opposite direction into the same feeder.

Recently, some new torque balancing methods for yarns also emerged in the Textile Research Journal, Vol. 65, No. 9, 1995, Sawhney and Kimmel described a series spinning system for processing torque-free yarns. The inner core of said yarns is formed by processing with an airjet system while outside the core is enwrapped with crust fibers similar to DREF-III yarns. In the Textile Research Journal, Vol. 62, No.

1, 1992, Sawhey etc. have suggested a method of processing ring cotton crust/polyester inner core yarns. Said yarns accomplish balancing by utilizing core yarns with opposite twisting direction from synthetic yarns, or applying heat processing on the polyester portion of said yarns. However, it is readily seen that the machines and processing techniques related to the aforesaid method are generally more complicated.

In the Textile Research Journal, Vol, 57, No. 10, 1997, Tao has processed the layer structure of the inner core-crust of rotor yarns to generate torque-free singles yarns, but said technique is not suitable for ring yarns.

In addition, U.S. Pat. No. 6,860,095 B2, filed by Tao et al. discloses a method of producing torque-free singles ring yarns. According to this patent application, a draft fiber is divided into a plurality of sub-assemblies of fibers. Each sub-assembly of fibers first attains an individual twist value during a false twisting, and then are twisted together to form the final yarns. The false twisting is controlled such that balancing of the internal torque of the final yarns is achieved. Furthermore, U.S. Pat. No. 7,096,655 B2 filed by Tao et al. discloses a method and apparatus for producing a singles ring yarn. In this method, a false twist device rotates at a first speed for twisting the fibers. Immediately after the first twisting step, a joint twist of the second twist in the same direction as the first twist and a third twist in a reversed direction is supplied to the preliminary yarn for producing final singles ring yarn. Moreover, the ratio of the first speed to the second speed is controlled for controlling the residual torque in the final singles ring yarn.

The aforementioned patents present the method and apparatus for singles ring yarn. However, the abovementioned patent application is more appropriate for torque-free singles ring yarn production in the laboratory scale. The yarn piecing-up and doffing process are not completely able to meet the practical requirements of large scale production in the textile industry. Furthermore, the spinning end-breakage when using ordinary cotton and the cost of investment and maintenance need to be further reduced for wide adoption in commercial application. In order to overcome the above shortcomings, two twisting points, instead of one twisting point, are adopted for the yarn false twisting to obtain the high false twist efficiency in this invention. In addition, the ratio of the velocity of the belt to the delivery speed of the yarn is controlled and the wrapping angle of the yarn on the belts is adjusted in order to obtain the desired properties of the final singles ring yarn.

SUMMARY OF THE INVENTION

Therefore, it is an objective of the present invention to provide an improved method and apparatus for producing singles ring yarns. The method and apparatus have the actual advantages of easy yarn piecing-up and doffing process, low spinning end breakage when using ordinary fibers and low cost of investment and maintenance. The method is thus not only able to meet the commercial requirements of the large-scale production in the textile industry but also possesses high false twist efficiency. Instead of one twisting point, two twisting points are adopted for the yarn false twisting to improve the false twist efficiency. Also, the false twist efficiency is controlled such that the desirable lower residual torque as well as other yarn properties can be achieved. Accordingly, a ratio of the velocity of the belt to the delivery speed of the yarn is controlled and the wrapping angle of the yarn on the belts is adjusted in order to obtain the desired property of the final singles ring yarn.

Another object of the invention is to provide a technique to solve the problems of appearance deterioration observed on yarns which are produced using low-twist and low-torque technologies, such as the double false twisting techniques disclosed in the present application. While those low-twist and low-torque methods are capable of producing satisfactory results in low-end products, they can cause appearance deterioration of the yarns, for example, unsatisfactory high numbers of neps, thick and thin places will present a problem in high-quality yarn products (see Table 1).

According to an aspect of present invention, a method for producing singles ring yarns is as follows.

A first high twist is imparted to a strand of traveling fibers emerged from the front-drafting-roller nip with the upper belt of a false twist device for producing a preliminary singles yarn, wherein the belt travels at a velocity for twisting the fibers and thus the strength of fiber strand is enhanced at the spinning triangle when a low twist level is adopted in the final singles yarn. Immediately after the false twisting step by the upper belt served as the first twisting point, a joint twist of a second twist in the same direction is imparted to the preliminary singles yarn for the production of a final singles ring yarn, wherein the second false twist is applied by running of the lower belt on the yarn. The rotating traveler imparts the yarn twist which will propagate upward to the false twist points. Then the final singles yarn was drawn onto the take-up package. The upper and lower belts run at the same speed but opposite direction.

Controlling a ratio of the velocity of the belts to the delivery speed of the yarn and the wrapping angle of the yarn on the belts can control the false twist efficiency for yarn and thus the yarn properties.

According to another aspect of present invention, an apparatus for producing singles ring yarns is as follows.

The upper belt of a false twist device traveling at the speed of the belt imparts a first high twist to a strand of traveling fibers emerged from the front-drafting roller nip such that a preliminary singles yarn is produced. The lower belt of a false twist device traveling at the same speed as the upper belt imparts a second twist in the same direction as the first twist to a preliminary singles yarn emerged from the upper belt such that a further preliminary singles yarn is produced. A rotatable take-up package onto which the final singles yarn is drawn imparts a third twist in the same direction as the first twist and second twist to a preliminary singles yarn such that final singles yarn is produced. The strength of the fiber strand is enhanced at the spinning triangle when a low twist level is adopted in the final singles yarn.

The ratio of the speed of the belts to the delivery speed of the yarn can be controllable and the wrapping angle of the yarn on the belts is adjustable such that the false twist efficiency and the yarn property can be adjusted.

According to a further aspect of the present invention, there is provided an apparatus for producing singles ring yarns with lowered residual torque and a reduced number of neps, which comprises a compact spinning device and a false twist device capable of producing two separate false twisting points. In operation, a traveling nascent strand of fibers is first running through the compact spinning device in the spinning triangle and then through the false twist device to be false twisted twice at two twisting points separately. The compact spinning device has a known effect of reducing hairiness of the yarn. It is not a part of the present invention by itself, and can be any known devices which are commercially available or customarily made with ordinary skill in the art, or to be made by technologies developed in future as long as they can achieve the similar technical effects as a compact spinning device as it is understood by a person of ordinary skill in the art. Currently, the preferred compact spinning device is a suction drum or suction tube.

Similarly, the false twist device is not part of the present invention by itself and can be any known devices which can be fitted to the spinning apparatus and create two separate false twisting points on a traveling yarn when it leaves the spinning triangle. Although, to the knowledge of the present inventors, such twisting device is not commercially available at the present time, the present disclosure provides sufficient information so that a person of ordinary skill in the art can make a double false twisting device for practicing the present invention. Among several embodiments of double-twisting devices and techniques disclosed herewith, the currently preferred one is the endless circular belt design as depicted in FIGS. 1-3, 5 and 12-15. While this particular design was similarly disclosed in PCT/AU97/00118 for its effect of reducing yarn breakages (the effects of lowering residual torque and reducing hairiness were not disclosed therein and were unknown in the art until the present invention). This patent application was published on Sep. 4, 1997 and, to the knowledge of the present inventors, there has been no commercial availability of this device, nor has there been any commercially available machine having this double twisting device installed either as an integral part or as an add-on. With this double-belt twisting design, the preferred speed of belt is between 6-68 m/min and the speed ratio between the belt and the yarn traveling is between 0.3-3.4. The preferred wrapping angle of the yarn on the belt is between 15-60°.

According to a further aspect of the present invention, there is provided a method for reducing residual torque in singles ring yarns for producing high-quality yarns or fine count yarns. The method comprises (a) compacting the traveling yarn in the spinning triangle and (b) double false twisting it outside the spinning triangle.

The preferred device for effecting the contacting step is a suction drum and the preferred device for effecting the double false twisting step is a single endless belt which twists the yarn twice with a upper part and a lower part of the belt, respectively. With this belt twisting design, the preferred speed of belt is 6-68 m/min and the speed ratio between the belt and the yarn traveling is 0.3-3.4. The preferred wrapping angle of the yarn on the belt is 15-60°. Of course, based on the operating principles disclosed herein, a person of ordinary skill in the art may find other parameters that can also produce satisfactory results.

The various features of novelty which characterize the invention are pointed out with particularity in the claims annexed to and forming a part of this disclosure. For a better understanding of the invention, its operating advantages, and specific objects attained by its use, reference should be made to the drawings and the following description in which there are illustrated and described preferred embodiments of the invention.

DETAILED DESCRIPTION OF PARTICULAR EMBODIMENTS OF THE INVENTION

Figure 1:
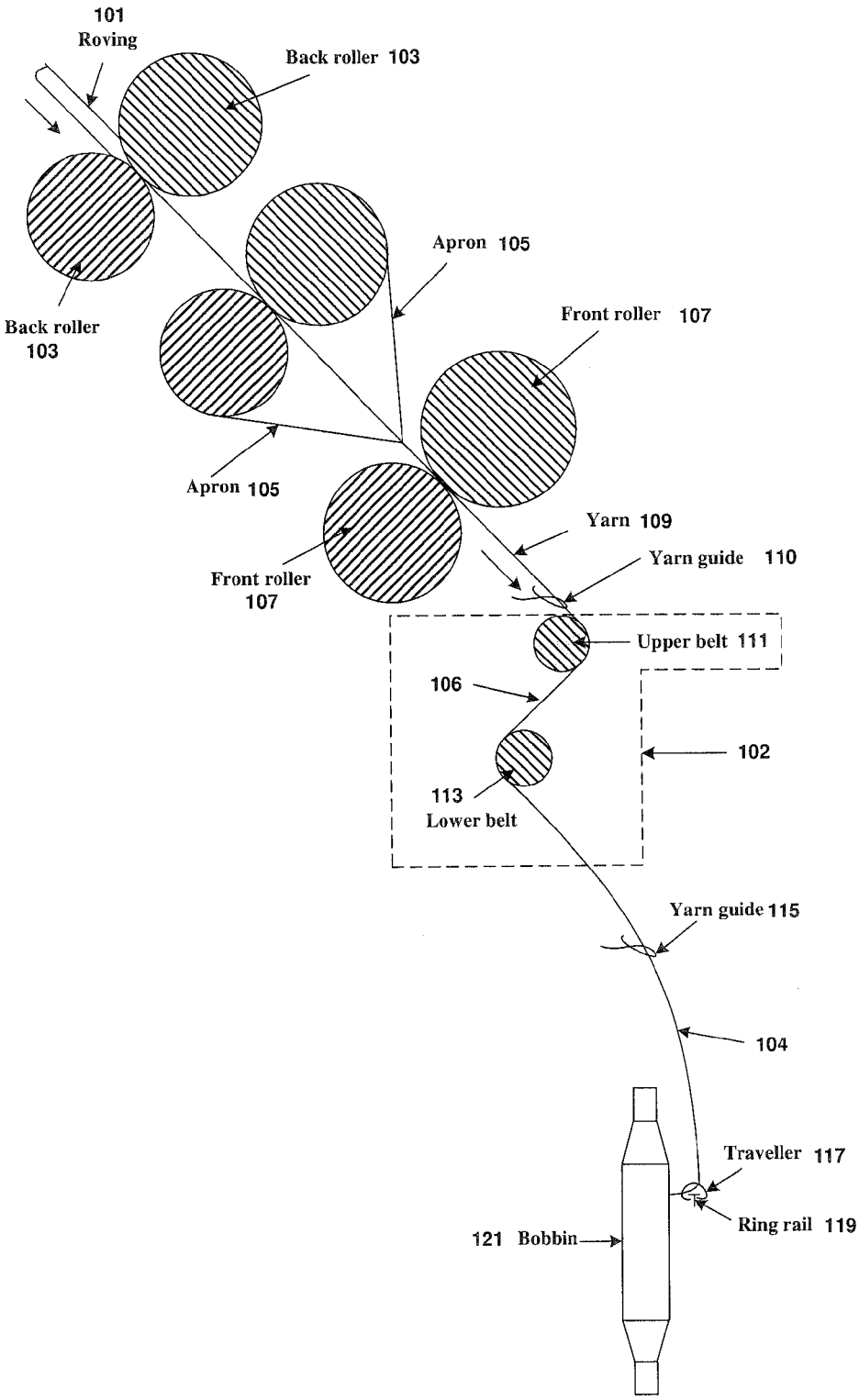
FIG. 1 is a side diagrammatic plan view of a spinning apparatus in accordance with an exemplary embodiment of the present invention.
Figure 2:
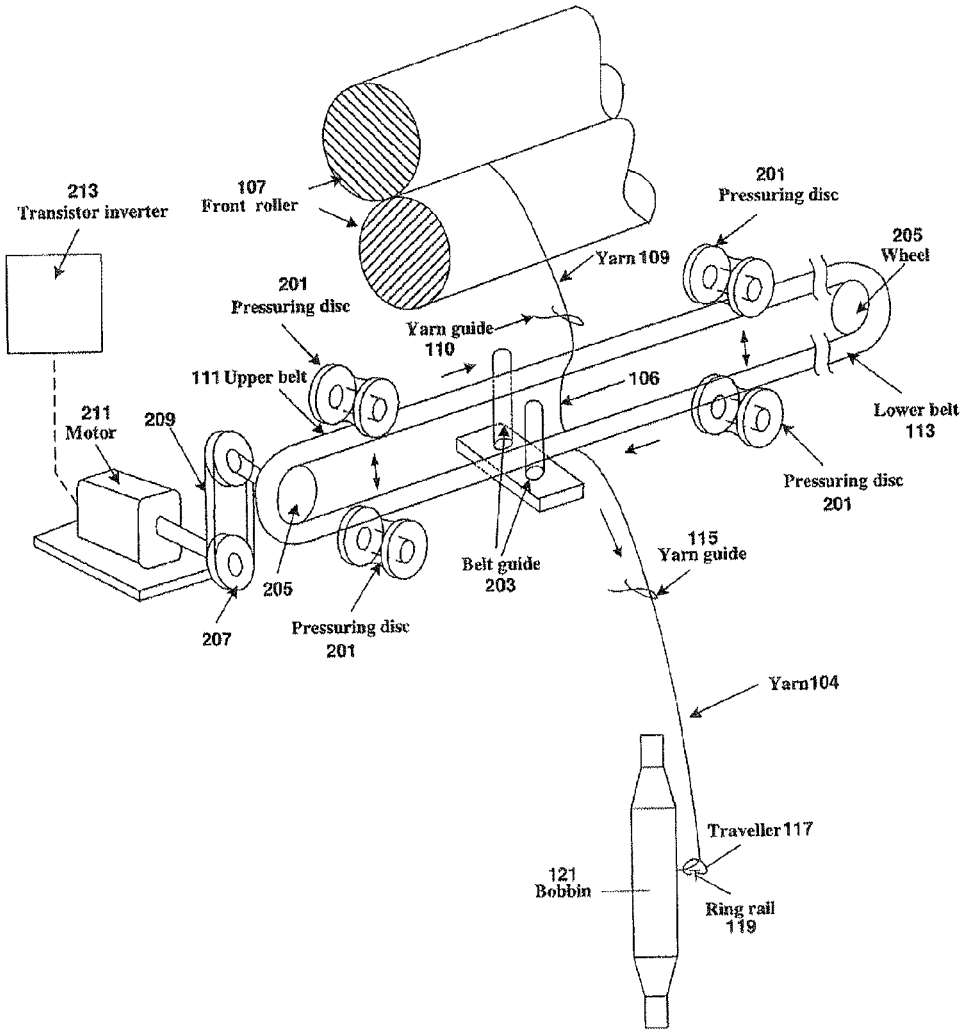
FIG. 2 is a schematic representative in perspective, of a spinning apparatus in accordance with an exemplary embodiment of the present invention.

FIGS. 1 and 2 illustrate aside diagrammatic plan view and a schematic representation in perspective of a spinning apparatus in accordance with an exemplary embodiment of the present invention, respectively. As shown in FIGS. 1 and 2, a roving 101 is delivered through the drafting system 103, 105 and 107, including a pair of back drafting rollers 103, a pair of aprons 105, and a pair of front drafting rollers 107. The drafted roving is twisted by the upper belt 111 of a false twist device 102 to form a preliminary singles yarn wherein the false twist for a yarn is provided by the running action of the upper belt 111. Immediately after the false twist step by the upper belt 111 serving as the first twisting point, a joint twist of a second twist in the same direction as the first twist and a twist travel toward the region in the reversed direction are imparted to the preliminary singles yarn 106 for the production of a final singles ring yarn, wherein the second twist is produced by a running of the lower belt 113 on the yarn, wherein the reserved twist results in correspondence to the first twist by a running of the upper belt 111 on the yarn.

Immediately after the false twist step by the lower belt 113 serving as the second twisting point, a joint twist of a forth twist in the same direction as the first twist and second twist, and a fifth twist in the reversed direction are imparted to the preliminary singles yarn for the production of a final singles ring yarn 104, wherein the forth twist is produced by a rotatable take-up package 121 onto which the final singles yarn is drawn, wherein the fifth twist results in correspondence to the second twist by a running of the lower belt 113 on the yarn. Then the yarn 104 proceeds to a yarn guide 115, and then further to the bobbin 121. The yarn 104 becomes wound on the bobbin 121 via a traveler 117 moving on a ring rail 119.

As shown in FIGS. 1 and 2, the double-belts twisting device 102 includes, in addition to other components, primarily an upper belt 111 and a lower belt 113. In the false twisting device 102, the upper belt 111 and the lower belt 113 are travelling in opposite directions with the same speed. The yarn 109 interacts with the false twisting device 102 in a slalom-like arrangement with two false twisting points, i.e., the yarn 109 interacts with the outer surface on one belt which serves as the first twisting point, then interacts on the inner surface of the other belt which serves as the second twisting point. In this case, the yarn 109 interacts with the outer surface of the upper belt 111 first then diverges to the inner surface of the lower belt 113, before exiting the false twister. In fact, the yarn is false twisted by the torque generated by running the double belts in opposite travelling directions.

Furthermore, in the exemplary embodiment, there are two false twisting points of a false twist device by the travelling upper belt and lower belt for the yarn. The false twist efficiency for the yarn depends on the friction between the yarn and the surface of the upper belt and lower belt, and the ratio of the speed of the belts to the delivery speed of the yarn. The residual torque and other yarn properties of the final singles ring yarn are controlled by controlling the friction between the yarn and the surface of the upper belt and lower belt, and the ratio of the speed of the belts to the delivery speed of the yarn.

The belt can be driven by a conveyor belt 209 having two or more pulleys 207, whereby at least one of the pulleys 207 is attached to a motor 211. The motor 211 is controlled by suitable electronics such as inverters 213. The motor 211 has the capability to drive the conveyor belt and further drive the double belts with a controllable ratio of the speed of the belts to the delivery speed of the yarn predetermined by the desired impartation of false twist and thus the resultant amount of residual torque as well as other yarn performance properties in the final singles ring yarn.

An additional yarn guide 110 installed above the upper belt 111 for each spindle is used to control the yarn movement during the spinning. The positioning of the yarn guide 110 should be carefully arranged in the installation. Excess amount of friction between yarn guide and yarn results in the yarn breakage while insufficient amount of false twist results in poor yarn strength. Several belt guides 203, installed on the both sides of the double belts 111 and 113, and several pressuring discs 201, installed on upper and lower sides of the belts 111 and 113, are used to control the belts' movement, as well as adjust the geometric interrelationships of the yarn and the upper belt and lower belt and the tension of the belts. Through the belt guides 203, pressurizing discs 201 and the wheels 205, the belts are maintained in a stable condition with predetermined tension.

Figure 3:
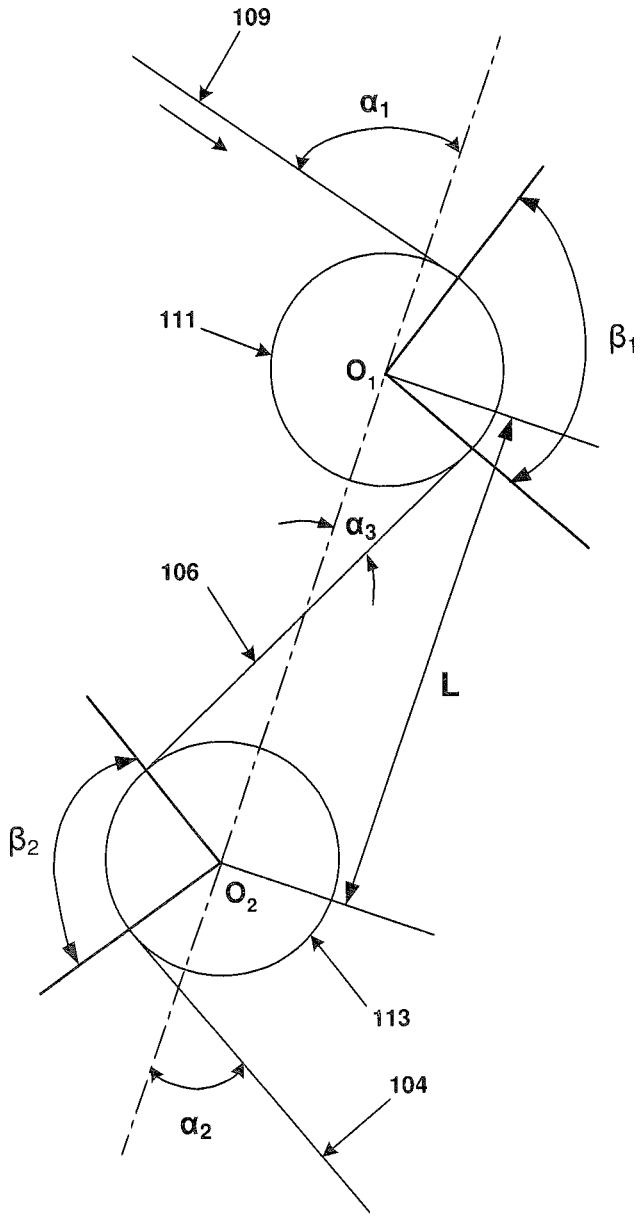
FIG. 3 is a side enlargement of part of FIG. 1 showing the geometry interrelations of the yarn, the upper belt and lower belt.

FIG. 3 is a side enlargement of part of FIG. 1 showing the geometric interrelationship of the yarn, the upper belt 111 and lower belt 113; As shown in FIG. 3, "$\alpha 1$", "$\alpha 2$" and "$\alpha 3$" represent the crossing angles of the straight line (O1O2) with respect to the travelling path of the yarn portions 109, 104 and 106 respectively, wherein "O1" is the center of the upper belt and "O2" is the center of the lower belt. "$\beta 1$" and "$\beta 2$" represent the wrapping angles of yarn portions on the upper belt and lower belt, respectively. "L" represents the length of the straight line which connects the center (O1) of the upper belt and the center (O2) of the lower belt. The geometry interrelation of the yarn, the upper belt and lower belt which is described by the crossing angles ($\alpha 1$, $\alpha 2$ and $\alpha 3$), wrapping angles ($\beta 1$ and $\beta 2$) and the length of the straight line (O1O2) is important in determining the optimal adaptation of the double-belts false twist device to the desired impartation of false twist, and in optimizing the yarn tension conditions.

Figure 4:
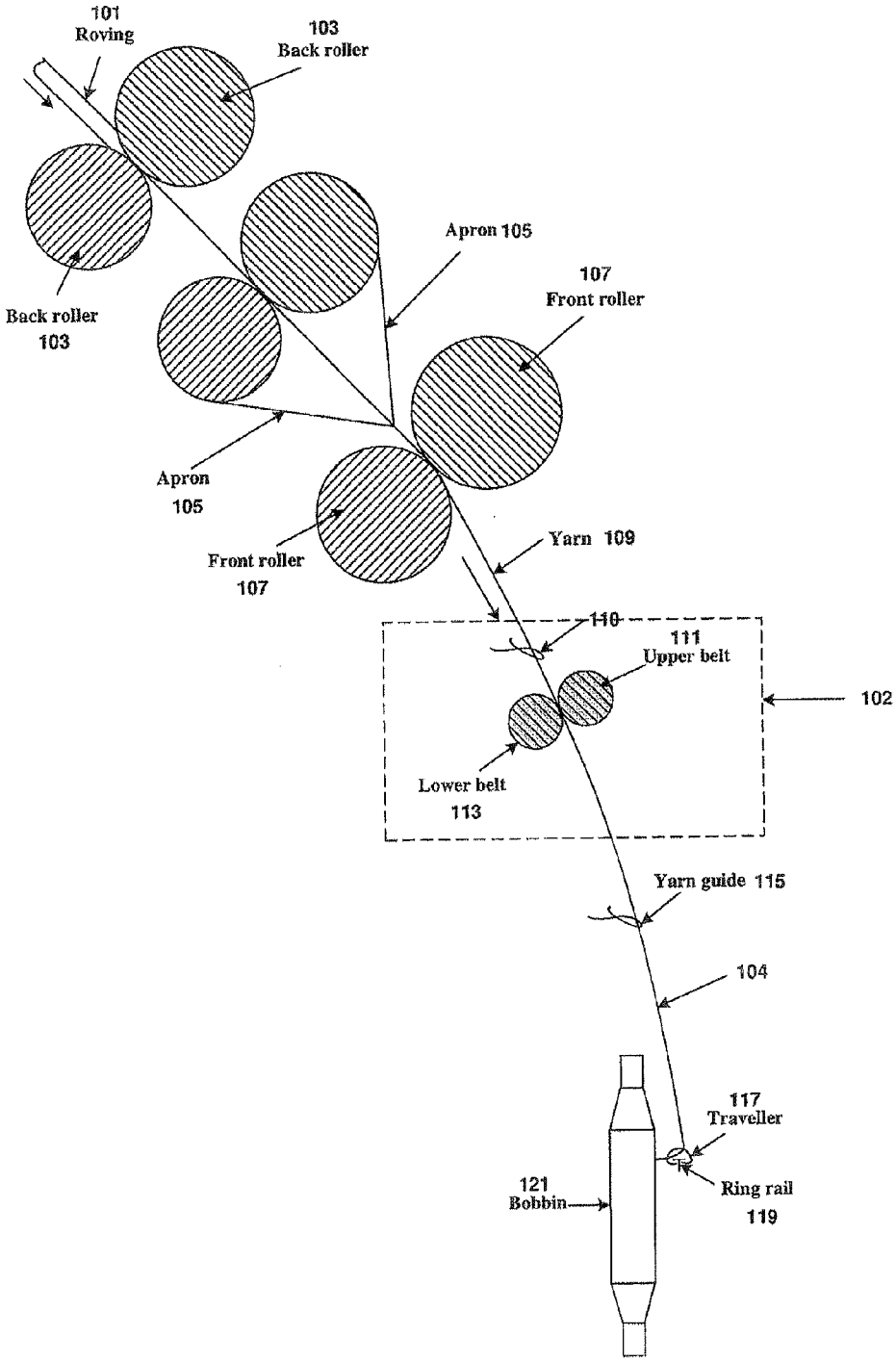
FIG. 4 is an alternative side diagrammatic plan view of a spinning apparatus in accordance with an exemplary embodiment of the present invention with a nip false twister consisting of the two belts.

FIG. 4 is an alternative side diagrammatic plan view of a spinning apparatus in accordance with an exemplary embodiment of the present invention with a nip false twister 102 consisting of the two belts. As shown in FIG. 4, the drafted roving is twisted by being contacted from opposite sides by the travelling upper belt 111 and lower belt 113 of a false twist device 102 to form a preliminary singles yarn wherein the false twist for a yarn is provided by the running action of the upper belt and lower belt 113 travelling in opposite directions. FIG. 4 provides the false twist device with one twisting point instead of two twist points shown in FIG. 1. Compared to the single belt false twisting device, the nip false twister can increase the pressure between the yarn and the belts.

Figure 5A:
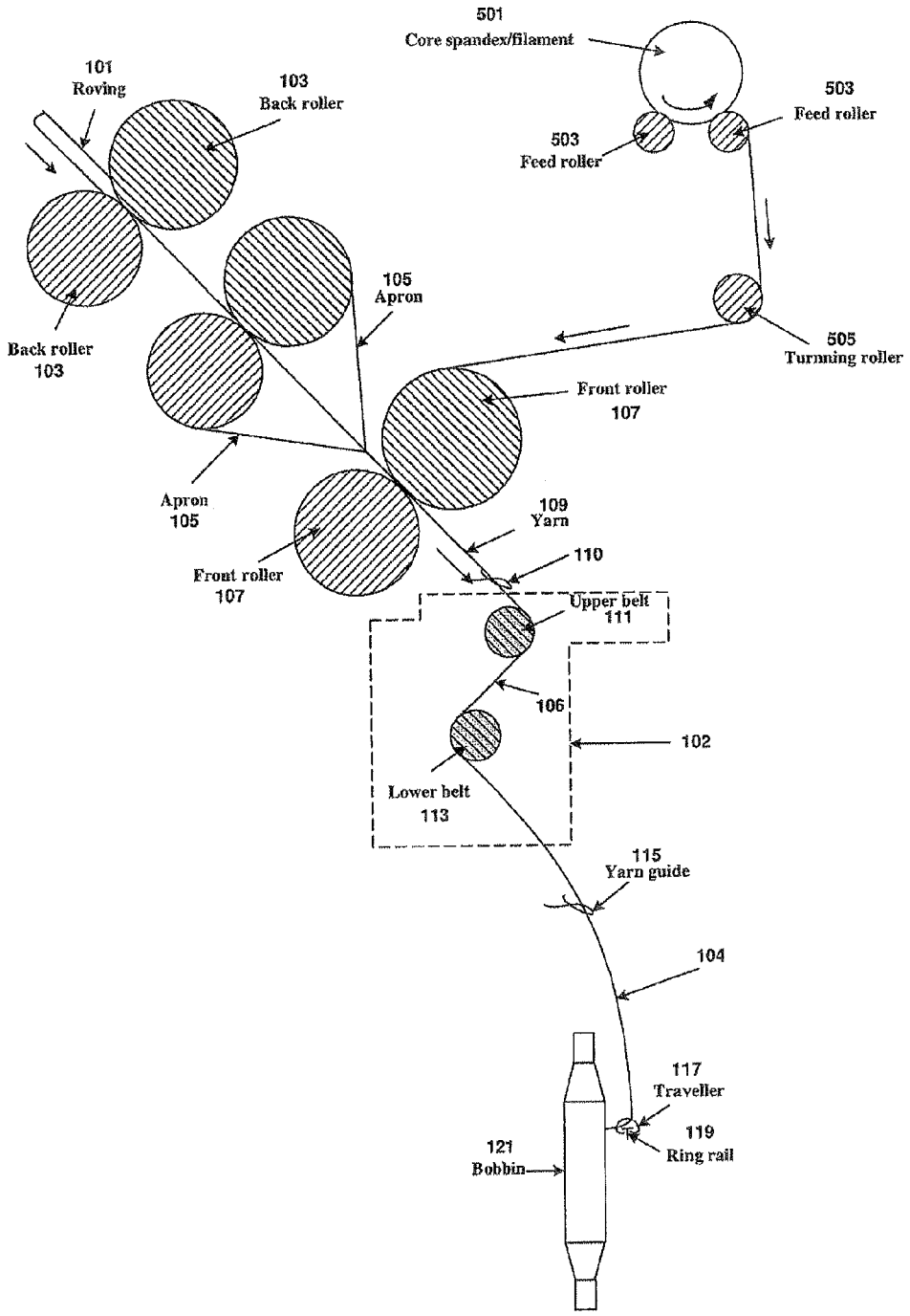
FIGS. 5A and 5B are two alternatives side diagrammatic plan views of a spinning apparatus of an exemplary embodiment of the present invention shown in FIG. 1 with core spandex/filament.
Figure 5B:
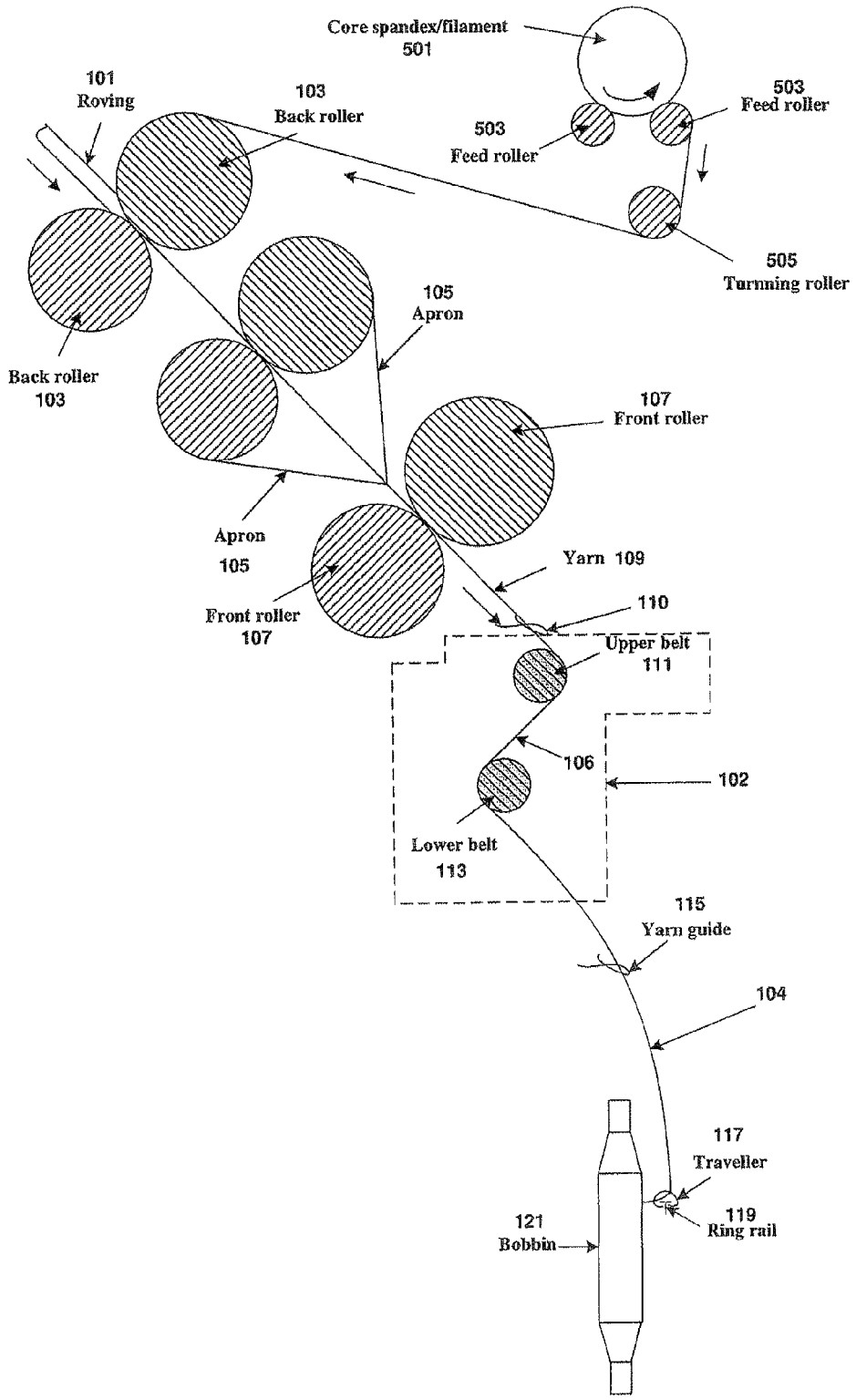

FIGS. 5A and 5B are two further embodiments of apparatus of the present invention as well as method shown in FIG. 1 for the core spandex/filament yarn. FIG. 5A provides an apparatus of the present invention for the core spandex/filament singles ring yarn. The spandex/filament 501 is delivered by feed rollers 503 and turning rollers 505 and then fed into the front rollers 107. The draft ratio is controlled by the surface speed ratio of the front rollers 107 to the feed rollers 503. FIG. 5B provides another apparatus of the present invention for the core spandex/filament singles ring yarn. The spandex/filament 501 is also delivered by feed rollers 503 and turning rollers 505 and then fed into the drafting system including a pair of back drafting rollers 103, a pair of aprons 105, and a pair of front drafting rollers 107. The draft ratio is controlled by the draft ratio of the drafting system and the surface speed ratio of the back rollers 103 to the feed rollers 503. Emerging from the front roller nip, the core spandex/filament and fibers twisted together by running the belts of the false twist device 102 and then rotating the take-up package 121 to form the final core spandex/filament singles ring yarn 104.

Figure 6A:
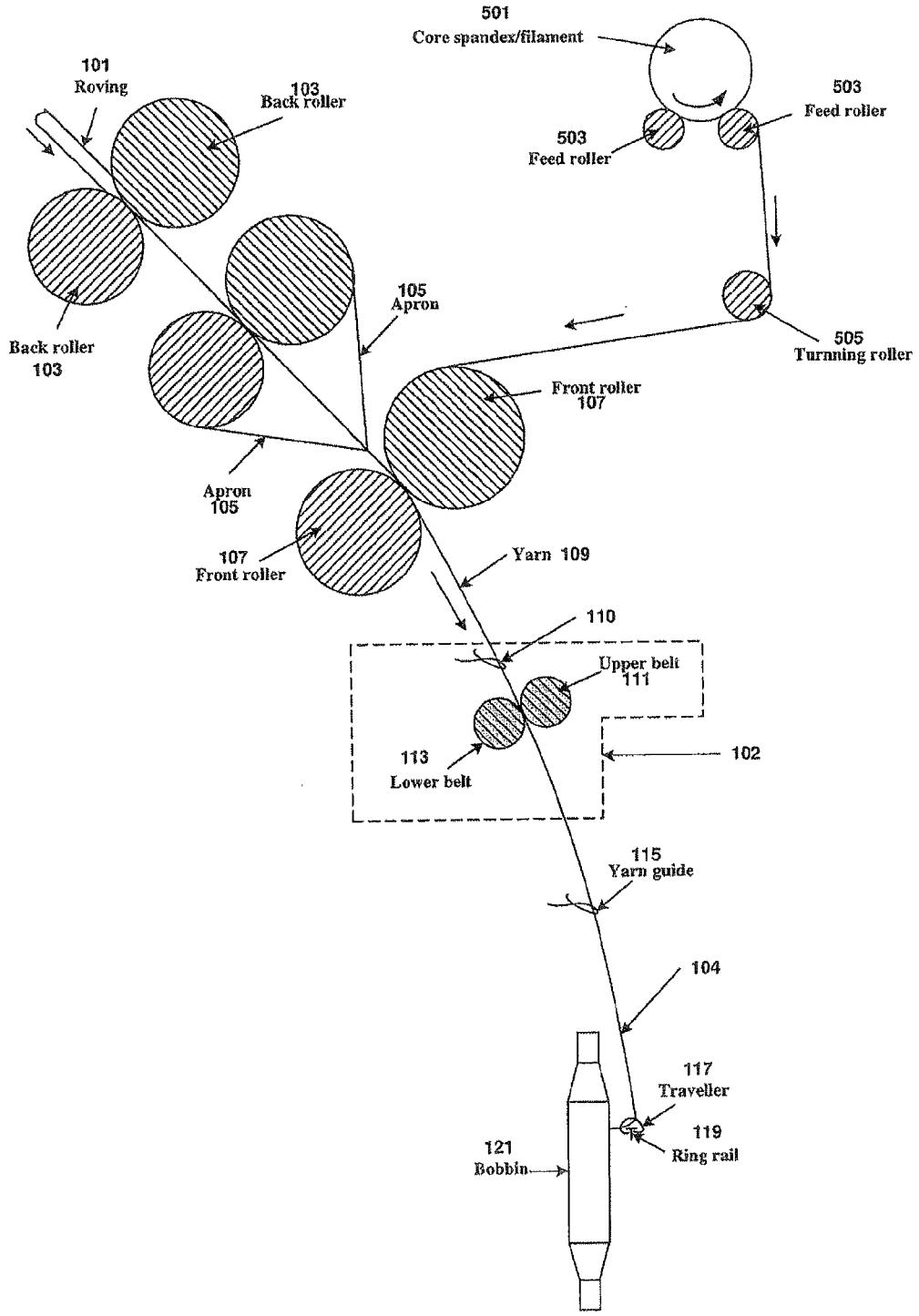
FIGS. 6A and 6B are two alternatives side diagrammatic plan views of a spinning apparatus of an exemplary embodiment of the present invention shown in FIG. 4 with core spandex/filament.
Figure 6B:
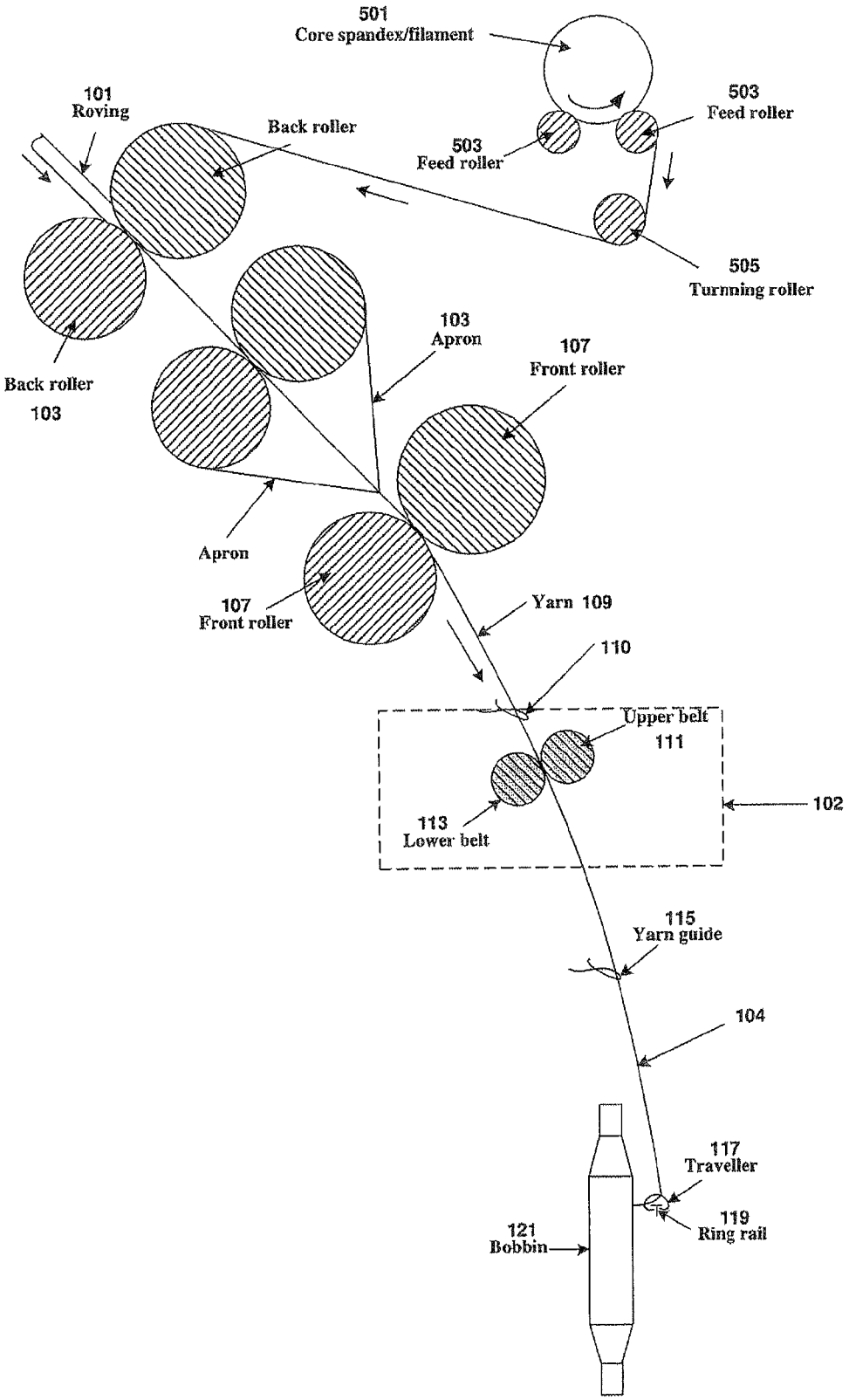

FIGS. 6A and 6B are two further embodiments of apparatus of the present invention as well as method shown in FIG. 4 for the core spandex/filament yarn. FIG. 6A provides an apparatus of the present invention for the core spandex/filament singles ring yarn. The spandex/filament 501 is delivered by feed rollers 503 and turning rollers 505 and then fed into the front rollers 107. The draft ratio is controlled by the surface speed ratio of the front rollers 107 to the feed rollers 503. FIG. 6B provides another apparatus of the present invention for the core spandex/filament singles ring yarn. The spandex/filament 501 is also delivered by feed rollers 503 and turning rollers 505 and then fed into the drafting system including a pair of back drafting rollers 103, a pair of aprons 105, and a pair of front drafting rollers 107. The draft ratio is controlled by the draft ratio of the drafting system and the surface speed ratio of the back rollers 103 to the feed rollers 503. Emerging from the front roller nip, the core spandex/filament and fibers twisted together by running the belts of the false twist device 102 and then rotating the take-up package 121 to form the final core spandex/filament singles ring yarn 104.

Figure 7A:
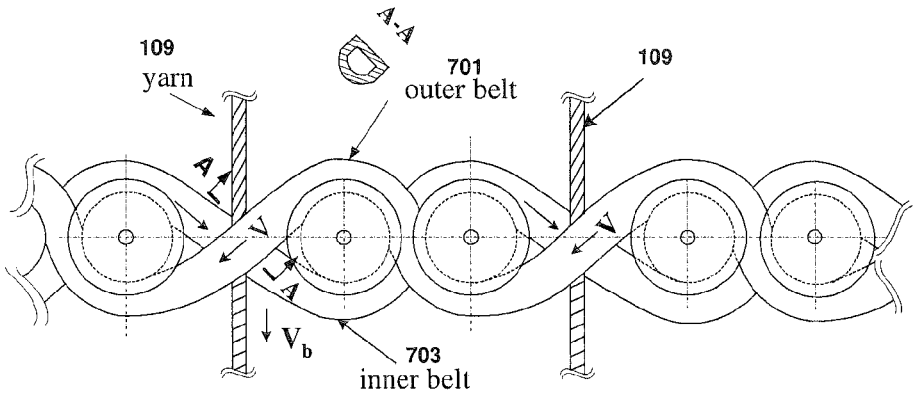
FIGS. 7A and 7B illustrate side and top diagrammatic plan views of a spinning apparatus of an exemplary embodiment of the present invention with two belts running in cross direction and FIG. 7C illustrates a cross section of a regulation block.
Figure 7B:
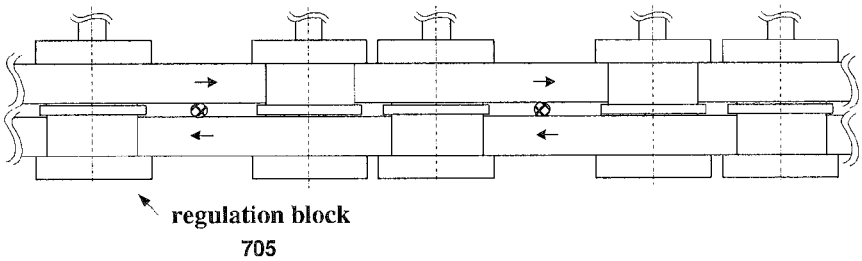
Figure 7C:
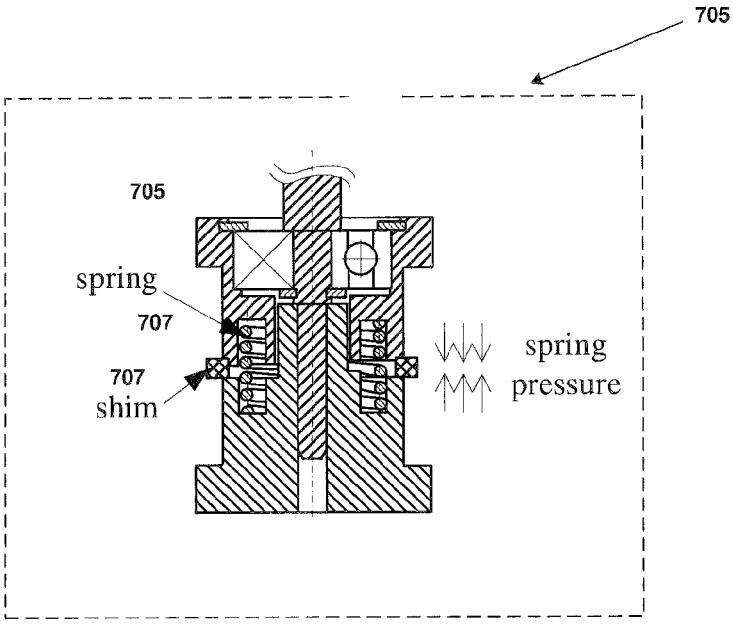

FIGS. 7A, 7B and 7C illustrate another embodiment of apparatus of the present invention as well as method with double belts running in cross direction and regulation block for the friction adjusting between the yarn and belts. As shown in FIGS. 7A, 7B and 7C, the outer face of the outer belt 701 is disposed in an opposing, substantially non-contacting relationship with the outer face of the inner belt 703, and defines a gap there between. A yarn 109 is advanced along the line at the velocity $V_b$ which bisects the angle formed by the two crossing belts, and through the twisting zone composed of the opposing belts 701 and 703 overlapped. The belts are pressed against the yarn in the area of the twisting zone by the regulation block 705 which consists of spring and shim assembly. The regulation block can adjust the friction between the yarn and the belts, improve the control of fiber movement during the false twisting of the yarn, provide an easier yarn piecing process as well as increase the false twist efficiency.

Figure 8:
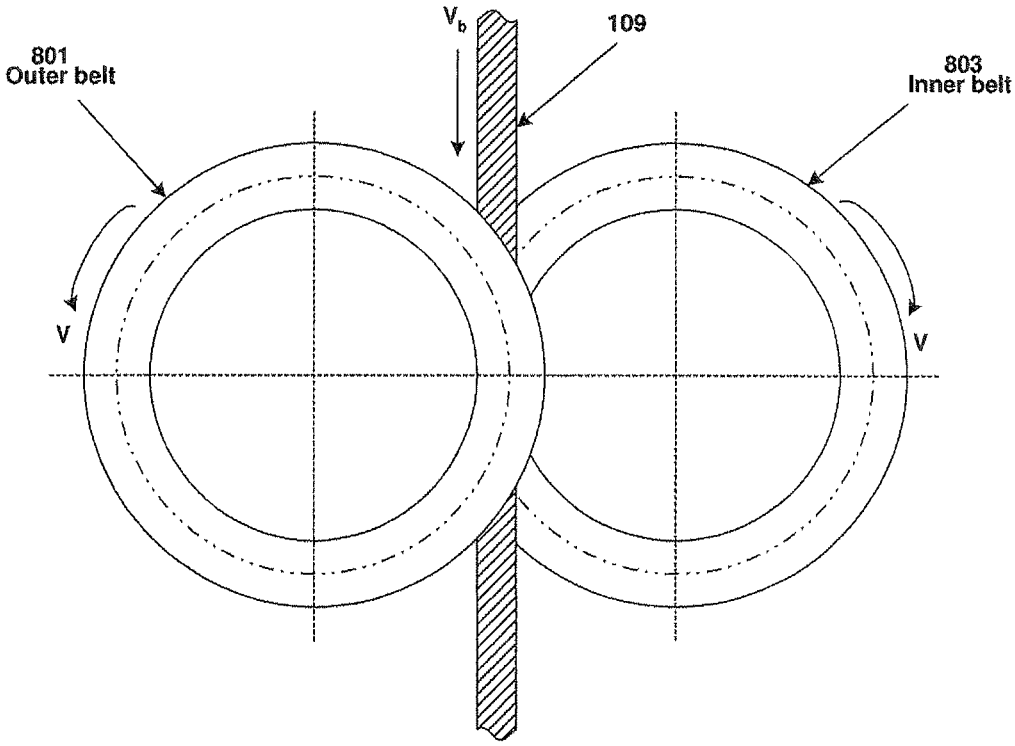
FIG. 8 is another alternative side diagrammatic plan view of a spinning apparatus of an exemplary embodiment of the present invention with two belts driving individually and running in cross direction.

FIG. 8 is another alternative side diagrammatic plan view of a spinning apparatus of an exemplary embodiment of the present invention with two belts driven individually and running in cross direction; As shown in FIG. 8, the outer face of the outer belt 801 is disposed in an opposing, substantially non-contacting relationship with the outer face of the inner belt 803, and defines two gaps there between. A yarn 109 is advanced along the line at the velocity $V_b$ which bisects the angle formed by the two crossing belts, and through the twisting zone composed of the opposing belts 801 and 803 overlapped. FIG. 8 provides the false twist device with two twisting point instead of one twist points shown in FIG. 7. Compared to the false twist device shown in FIG. 7, the false twist device shown in FIG. 8 can adjust the contact area between the yarn and belts to further improve the control of fiber movement during the false twisting of the yarn, increase the false twist efficiency as well as provide an much easier yarn piecing process.

Figure 9:
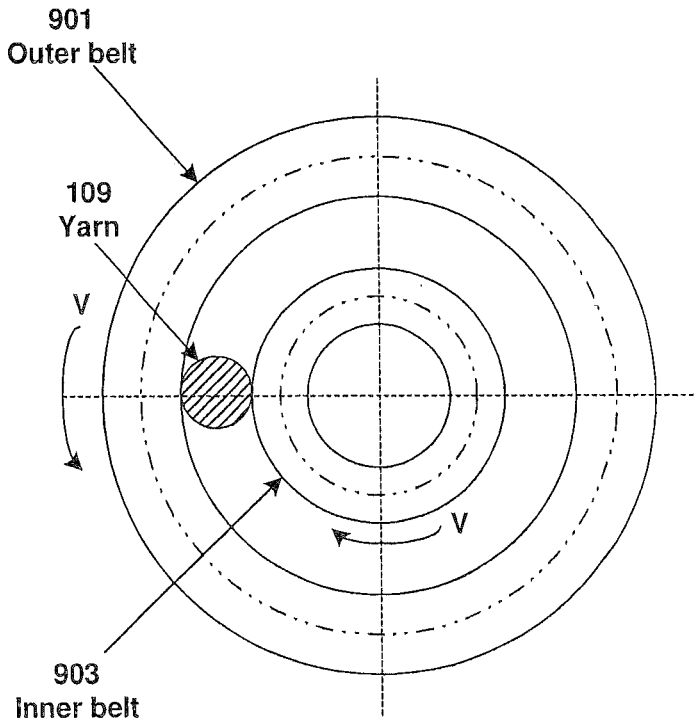
FIG. 9 is another alternative top diagrammatic plan view of a spinning apparatus in accordance with an exemplary embodiment of the present invention with a nip false twister consisting of the two belts arranged in concentric circle.

FIG. 9 is another alternative of a top diagrammatic plan view of a spinning apparatus in accordance with an exemplary embodiment of the present invention with a nip false twister consisting of the two belts arranged in concentric circles. As shown in FIG. 9, the yarn 109 is false twisted by the running action of outer belt 901 and inner belt 903 travelling in opposite direction in a false twist device to form a preliminary singles yarn. The outer belt 901 and inner belt 903 can be driven individually in high velocity of V as well as in more stable running condition to increase the false twist efficiency.

Figure 10:
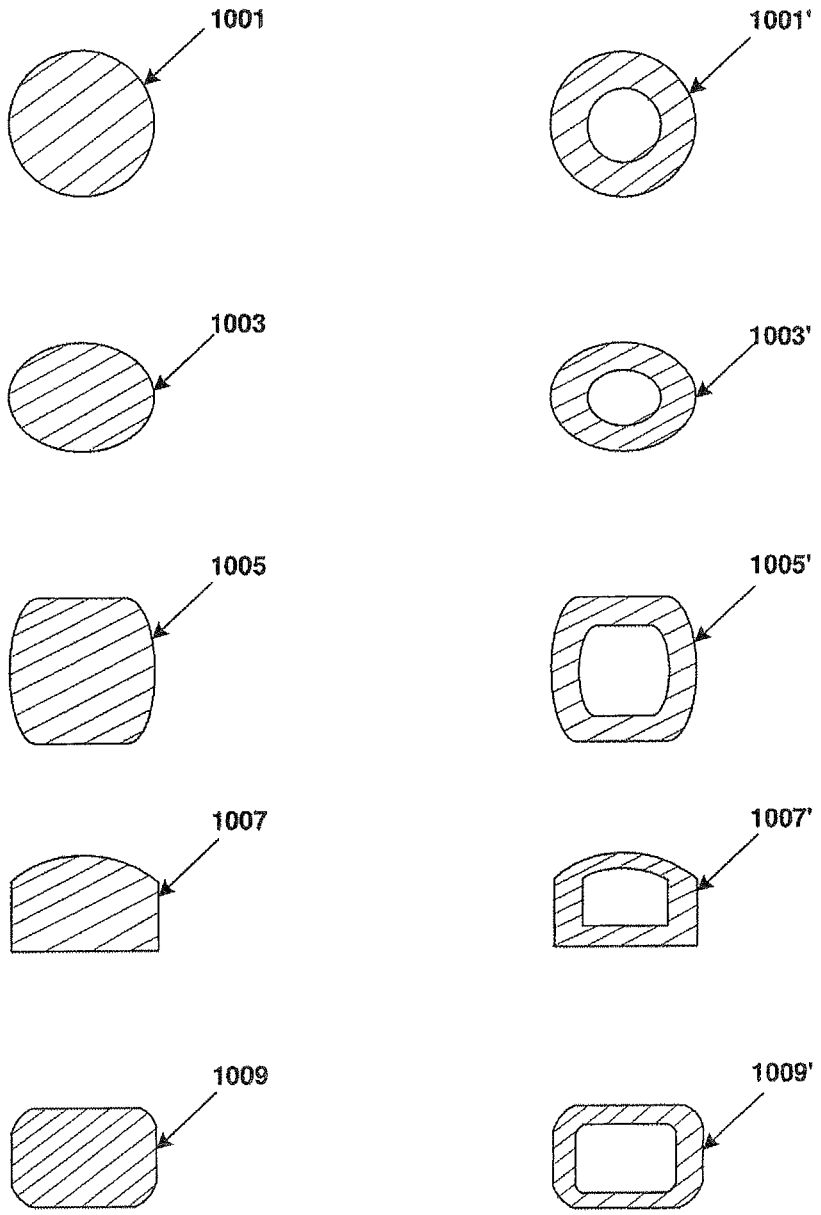
FIG. 10 illustrates ten alternatives cross-sectional profiles of the false twist belt shown in FIGS. 1-9.

FIG. 10 illustrates ten alternatives cross-sectional profiles of the false twist belt shown in FIGS. 1-9. The belt profile particularly the shape of the contacting section of the belt with the yarn, the hardness as well as the surface property of the belt are important for false twisting effects. The round shape and elliptical shape illustrated by the cross-sectional profiles 1001 and 1003 for the belt are two desirable contacting shapes with the yarn during the yarn false twisting. The cross-sectional profile 1001' and 1003' for the belt are another two alternatives with a hollow core which results in the reduction of hardness of the belt and thus changes the friction between the yarn and the belt. All these four types of belt shapes can be used for the yarn false twisting process shown in FIGS. 1-6, and which one is to be used mainly depends on the required false twisting effects. The cross-sectional profiles 1005, 1007 and 1009 are the other three shapes for the belt and the cross-sectional profiles 1005', 1007' and 1009' are their corresponding three alternatives with hollow cores, wherein the top shape is for the contacting area of the belt with the yarn. All these six types of belt shapes can be used for the yarn false twisting process showed in FIGS. 7-9.

Figure 11:
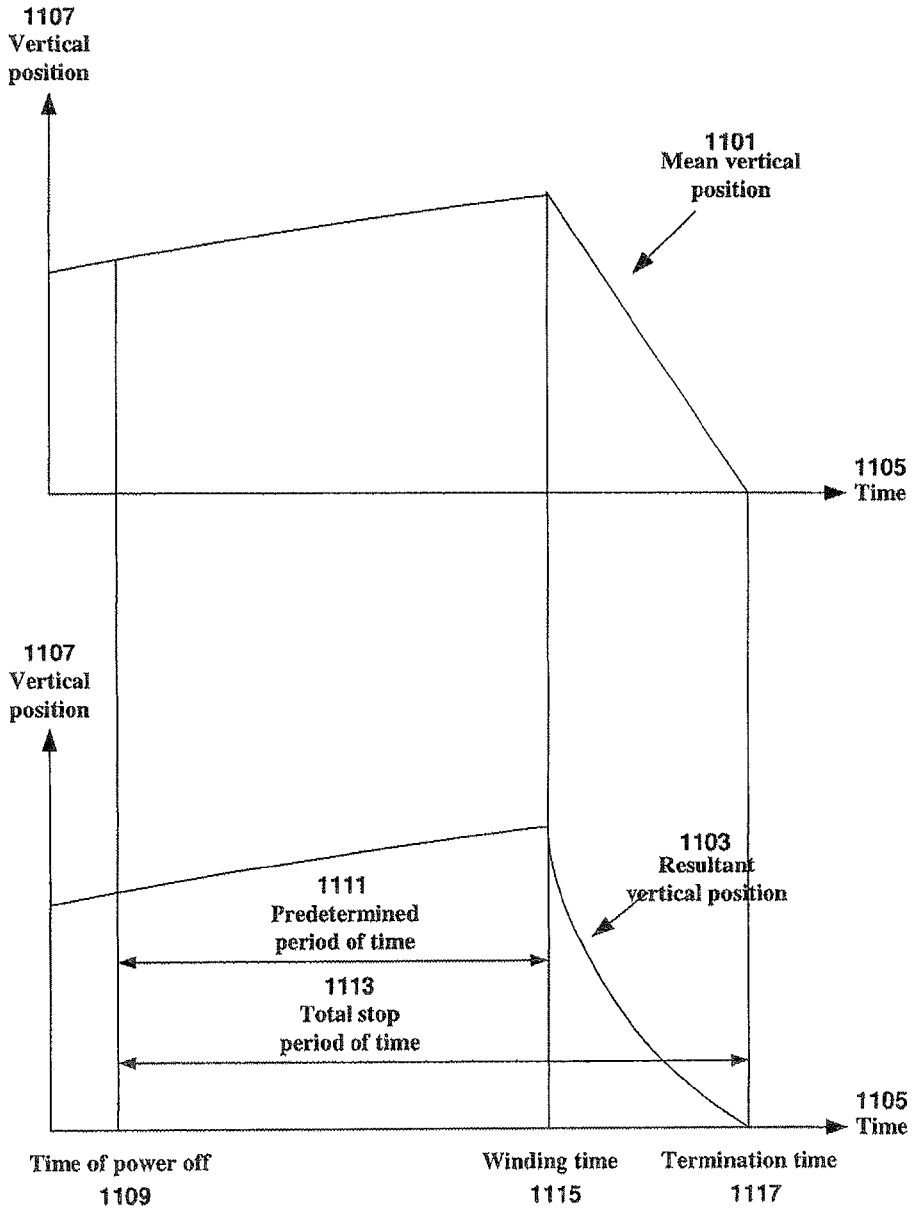
FIG. 11 is a diagrammatic view of the modified curves of vertical positions relative to time of a ring for yarn doffing.

FIG. 11 is a diagrammatic view of the modified curves of vertical positions relative to time of a ring for yarn doffing. The modifications have been proposed on the conventional doffing process to avoid yarn snap during doffing process. In FIGS. 11, 1101 and 1103 are respectively the modified curves of the mean vertical position and the resultant vertical position of the ring rail. Two axes of the coordinates represent time 1105 and vertical position 1107, respectively. According to an exemplary embodiment of the present invention, the spinning apparatus is powered off at time 1109 which should be matched to the power off time of the motor 211 when the ring rail moves upwards to the up-most position. Thereafter, the ring rail is waited for a predetermined period of time 1111. Then it is finally pulled down the ring gradually at the winding time 1115 until the ring completely stops at the termination time 1117, wherein 1113 indicates the total stop period of time.

The use of the double false-twisting technique according to the present invention alone may be sufficient for producing reasonable quality yarns. This double false-twisting technique has achieved the following effects: (1) improving the yarn structures substantially in terms of fiber packing density and fiber configuration. For example, the central packing density can reach as high as 90%, and the average inclination angle of fibers can be reduced by 30-40%. (2) reducing yarn hairiness by at least 50% from what is achievable by compact spinning which is a more complicated, more expensive process; (3) reducing yarn residual torque by 40% or more; (4) reducing yarn twist by 20% or more yet keeping the same yarn strength, which means increasing productivity of yarn spinning by 20% or more; and (5) enhancing yarn and fabric softness significantly. While in the present invention, the double-belt twister (implemented as a single endless belt) depicted in FIGS. 1-3, 5 and 12-15 was used for actual testing, any other device (some examples are disclosed in FIGS. 7-9) that can produce two false twisting points on the traveling yarn in a similar manner as disclosed in the present invention may also achieve substantially similar effects. The preferred double-belt twister was substantially disclosed in PCT/AU97/00118, which however disclosed it only as a means for reducing yarn breakage and never disclosed any other ways of using the device for any other purposes.

Figure 12:
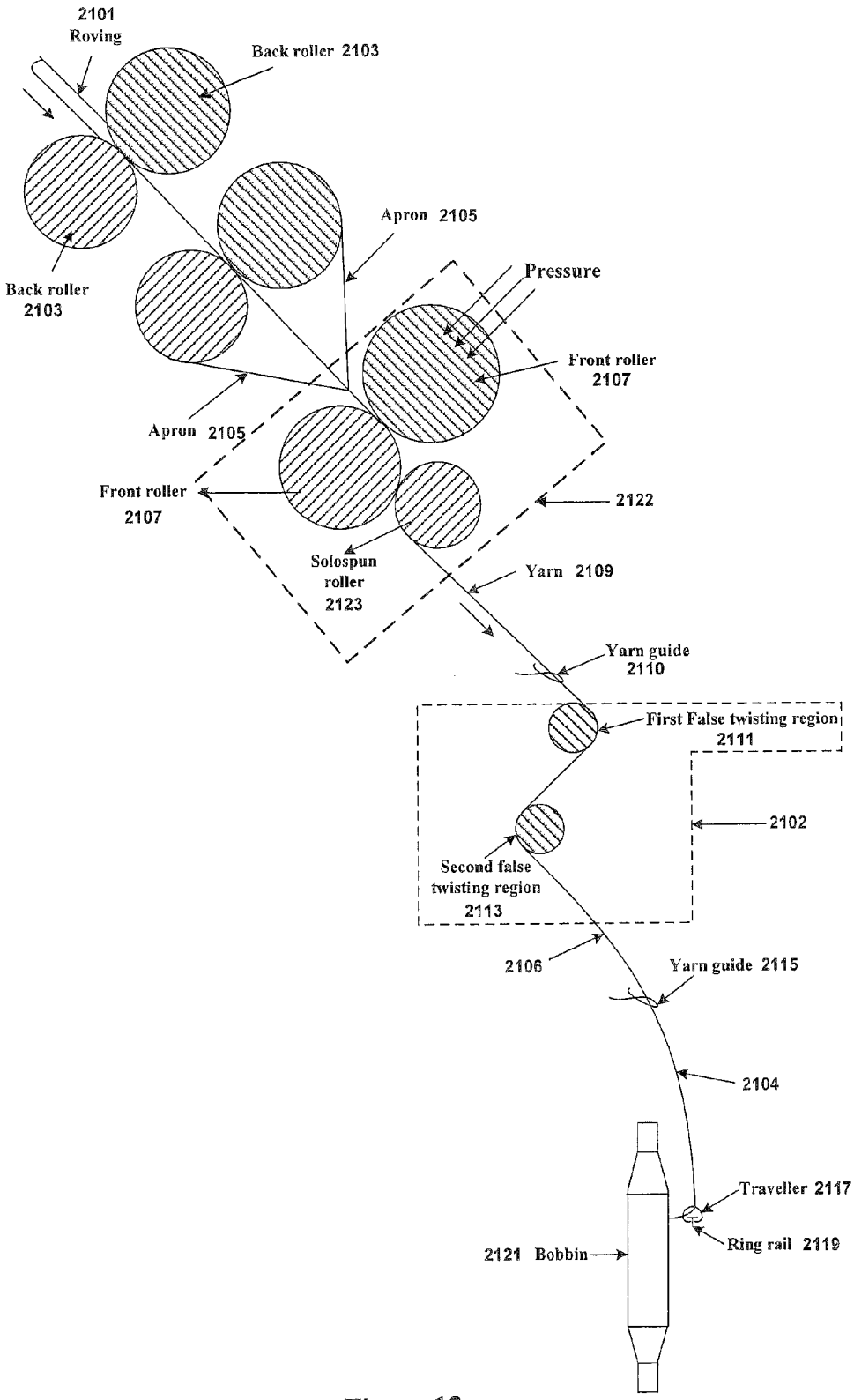
FIG. 12 is a side diagrammatic plan view of a spinning apparatus combining a compact spinning device, which is a mechanical device separating the fiber strand into two or multiple sub-strands in the spinning triangle, and a double twisting device according to the present invention.
Figure 13:
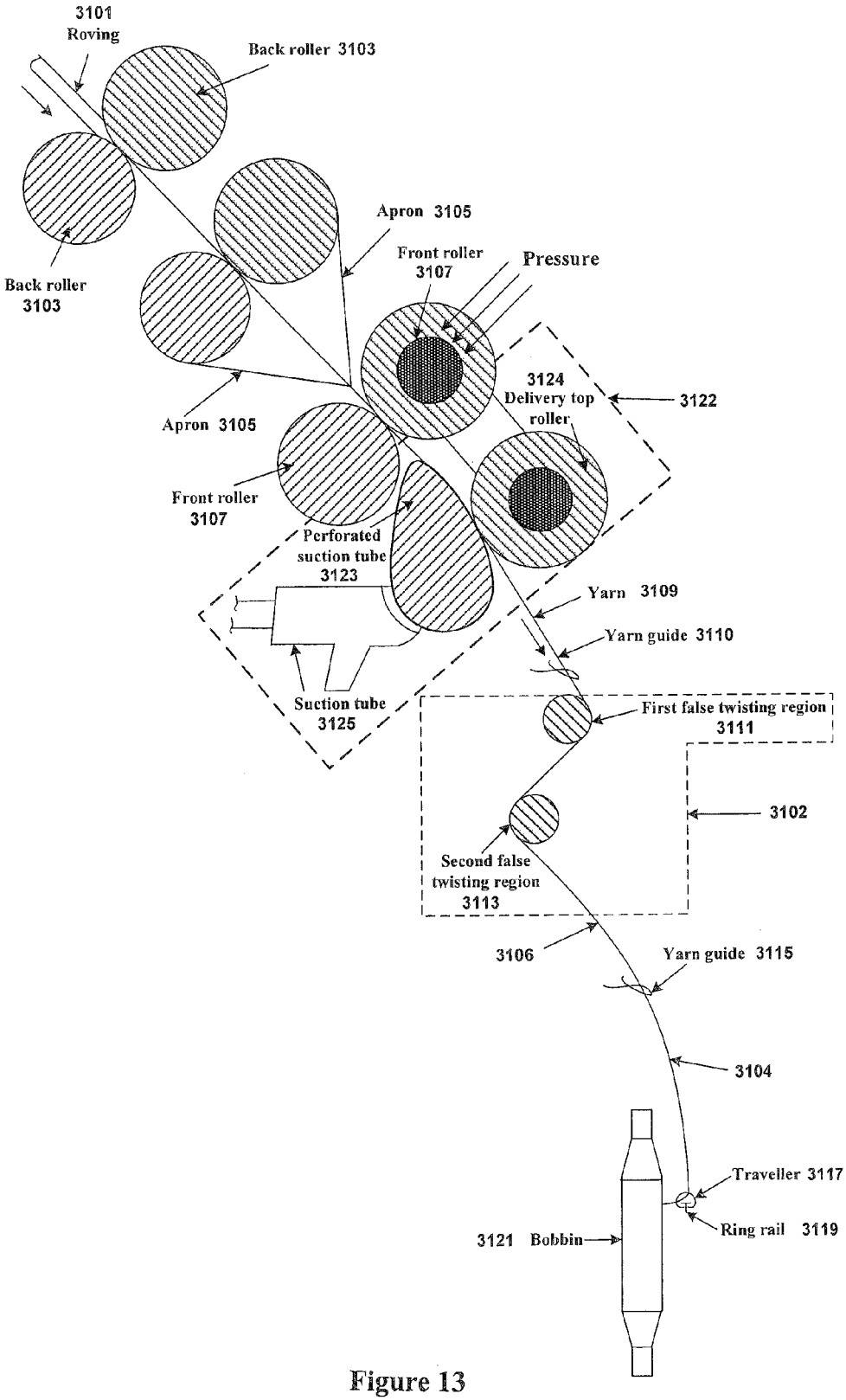
FIG. 13 is a side diagrammatic plan view of a spinning apparatus combining a compact spinning device, which is a suction tube to apply negative air suction in the spinning triangle, and a double twisting device according to the present invention.
Figure 14:
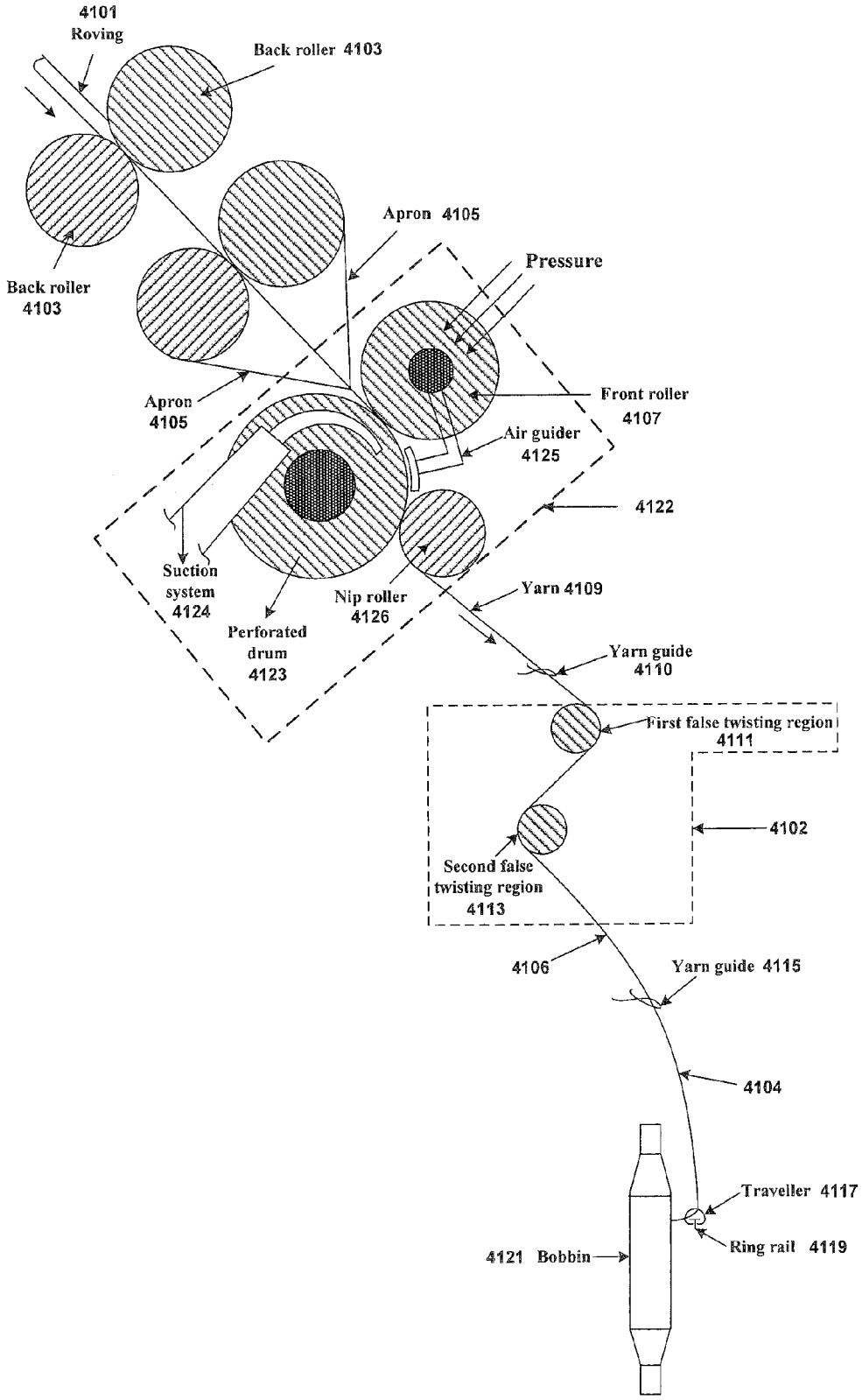
FIG. 14 is a side diagrammatic plan view of a spinning apparatus combining a compact spinning device, which is a suction drum to apply negative air suction in the spinning triangle, and a double twisting device according to the present invention.
Figure 15:
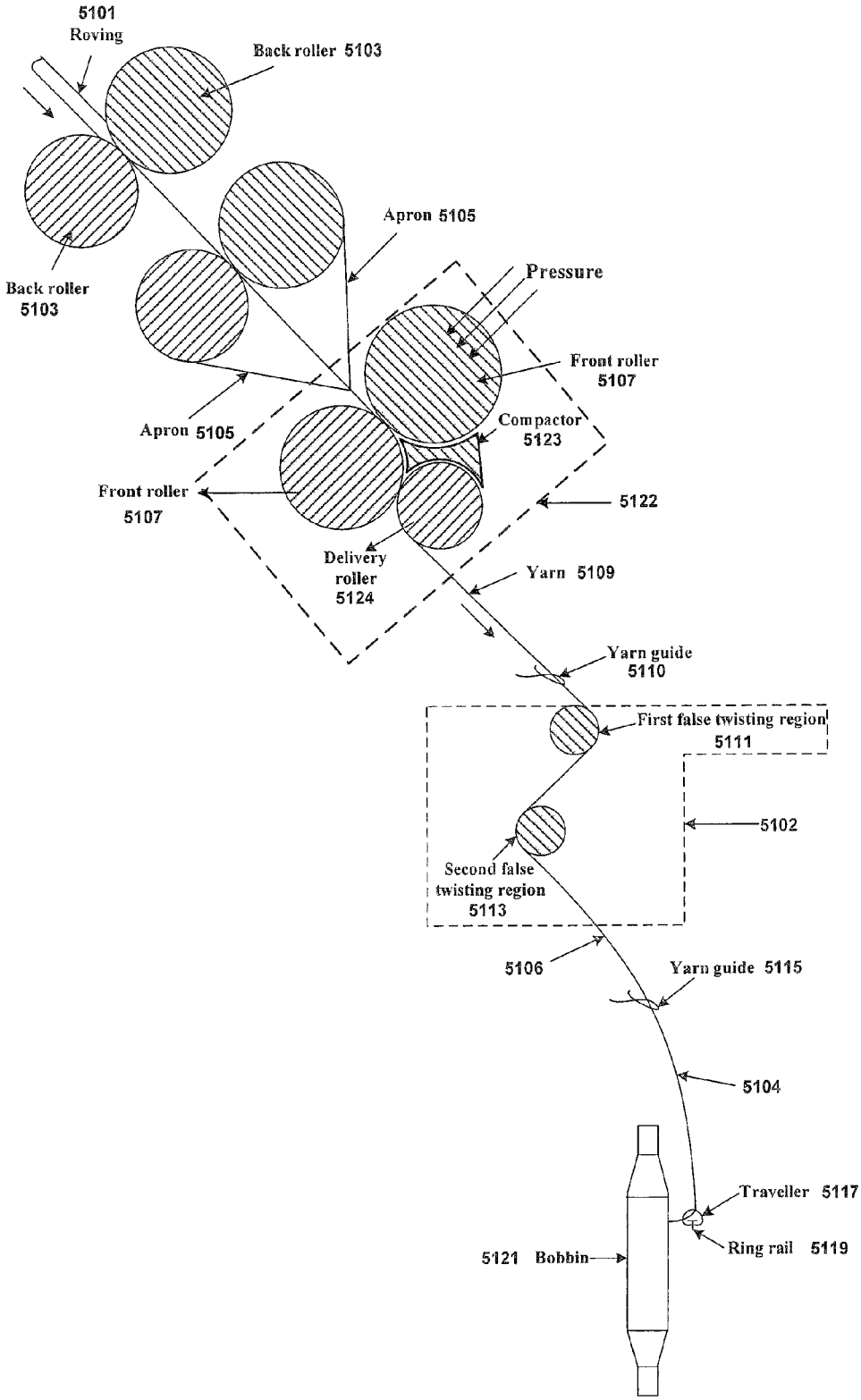
FIG. 15 is a side diagrammatic plan view of a spinning apparatus combining a compact spinning device, which is a mechanical device constraining and binding the protruding fiber ends into the fiber strand before the yarn twist point, and a double twisting device according to the present invention.

For producing finest quality yarns or yarns for high-quality products, it was subsequently discovered that the double-twisting technique disclosed above in the present invention alone was not sufficient because significant numbers of neps, thick and thin places are present in the yarns, as shown in the Table 1. Hence, the appearance of the yarn deteriorates and is not acceptable in high-quality products. This necessitated further efforts in the present invention to solve the problem. Consequently, various preferred embodiments were developed as shown in FIGS. 12-15 which eliminated the problems. These more preferred embodiments each comprise the following components: (a) a compact spinning device (may comprise one component or a combination of multiple components that achieve a compact spinning effect); and (b) a linear and open false twisting device that has two individual false twist regions the yarn with programmed ratio between the surface linear speed of the false-twister and yarn delivery speed. The compact spinning device can be any type of compact spinning devices known in the art, such suction drums, suction tubes, etc., and the false twisting device can be any device as long as it can impart two-false twisting points on the yarn. The one using an endless double-belt is preferred. FIG. 12 depicts a spinning system embodiment with a combination of a pressure adjusting component (formed at two front rollers 2107) for improving the gripping of individual fibers coming out of the drafting zone and a twisting component 2101 which has a first false twisting point 2111 and a second twisting point 2113. FIGS. 13 and 14 illustrate two embodiments, each comprising a pressure adjusting component (formed at two front rollers 3107), an air suction compact spinning component 3122, and a twisting component 3102 which has a first false twisting point 3111 and a second twisting point 3113. The difference between FIGS. 13 and 14 is the type of air suction mechanisms used. FIG. 13 shows a perforated suction tube used while a perforated drum in FIG. 14. The negative air suction provides effective control of free fiber ends in the spinning triangle but may cause some loss of fibers in the process. FIG. 15 is an embodiment that does not need air suction, but uses a mechanical block with a compact channel to mechanically constrain free fiber ends, as disclosed in Chinese Patent Application No. 201010507189.5. Compared to the suction devices, it is less expensive and easier to apply, but accumulation of contamination in the compact channel by waxy or oily fibers may pose difficulties in spinning. Users of ordinary skill in the art may choose any compacting techniques according to their specific needs under particular situations.

Table 1 shows comparative results of the yarn properties made by the embodiments with and without tucking the long fiber ends prior to entering the false twisting zone. Two trials were conducted with the same set of parameters except that the first trial was using the spinning apparatus with the linear and open false twisting device alone (i.e., the upper and lower belt of a single endless belt shown in FIG. 1) and the second trial was with a spinning apparatus including the components shown in FIG. 12, where a suction drum was used as the compact device (the suction drum was manufactured by Rieter, catalog number K44. The normal force of the front rollers was set at 18 Kg, middle cradle at 10 Kg and back roller at 17 Kg. The spindle spinning speed is 11000 rpm. The speed ratio was 0.85. In the two trials, the same cotton fibers were used for making one the same type yarn (50 Ne and 23 turns/inch).

As it can be seen from the results that the improvement brought about by the combination was dramatic in terms of neps reduction: the Neps (140%) was reduced from 1245 to 185. In almost every respects of yarn properties, the combination produced improvement.

TABLE 1

Comparative Experimental Data

| YARN PROPERTY | ITEM | FIRST TRIAL | SECOND TRIAL |
|---|---|---|---|
| YARN COUNT | Mean | 49.6 | 49.6 |
| | CV % | 0.9 | 0.8 |
| EVENNESS | U % | 10.8 | 9.9 |
| | CV % | 13.6 | 12.4 |
| IMPERFECTION | THIN PLACES (−40%) | 146 | 40 |
| | THIN PLACES (−50%) | 4 | 1 |
| | THICK PLACES (+50%) | 42 | 21 |
| | NEPS (140%) | 1245 | 185 |
| | NEPS (+200%) | 174 | 44 |
| HAIRINESS (USTER) | (H) | 4.54 | 3.78 |

TABLE 1-continued

Comparative Experimental Data

| YARN PROPERTY | ITEM | FIRST TRIAL | SECOND TRIAL |
|---|---|---|---|
| | SH | 1.20 | 0.88 |
| ZWEIGLE | 1 MM-3 MM | 12602 | 9477 |
| HAIRINESS | 4 MM-10 MM | 163 | 14 |
| TENACITY | CN/TEX | 20.79 | 21.08 |
| | CV % | 10.7 | 7.7 |
| | ELONGATION (%) | 4.9 | 5.3 |
| | CV % | 9.6 | 9.4 |
| TWIST | TURNS/INCH | 23.0 | 22.9 |

Thus, with the addition of a compact spinning device, an effective solution is provided in the present invention to produce high-quality yarns with low residual torque, low twisting, low hairiness and low rate of neps. This solution is unexpected and outside of conventional thinking. Given the fact that the double-twisting device of the present invention is regarded a less-expensive replacement for a compact spinning device (i.e., the double-twisting device can achieve the same or better effect in reducing yarn hairiness with less cost as the compact spinning device), it would not make sense to put these two devices in a sequence because of added installation and operational costs. Indeed, for general purposes of producing lower-end or coarse count yarns, the double-twisting technique alone would be an adequate replacement for a more expensive setup with the compact spinning device. However, in the present invention, it was surprisingly discovered that combination use of both the compact spinning device and a double false twisting device can have an unexpected effect of solving the problem (i.e., the presence of neps, thick and thin places in the yarn) introduced by the double-twisting technique. The improvement brought by the combination is of such a degree which justifies the extra cost of adding a compact spinning device to the double-twisting technique of the present invention, particularly for producing high-quality yarns and fine count yarns.

While there have been described and pointed out fundamental novel features of the invention as applied to a preferred embodiment thereof, it will be understood that various omissions and substitutions and changes, in the form and details of the embodiments illustrated, may be made by those skilled in the art without departing from the spirit of the invention. The invention is not limited by the embodiments described above which are presented as examples only but can be modified in various ways within the scope of protection defined by the appended patent claims.

What is claimed is:

1. A method for reducing residue torque in singles ring yarns, comprising the steps of:

(a) imparting a first false twist to a strand of traveling fibers at a first twisting point after said strand exiting from a spinning triangle of a spinning apparatus, and (b) imparting a second false twist to said strand after said strand passing said first twisting point;

wherein said false twisters are operating at a speed ratio of 0.85 spinning to false twisting.

2. The method of claim 1, wherein said false twisters are operating at a linear speed between 6-68 m/min.

3. The method of claim 2, wherein said linear speed is 53 m/min.

4. The method of claim 1, further comprising a step of compacting said strand of travelling fibers prior to being false twisted at step (a).

5. The method of claim 4, wherein said step of compacting is effected by a mechanism of air suction within said spinning triangle.

6. An apparatus for producing singles ring yarns comprising (a) a compact spinning device; and (b) a false twist device having two separate false twisting points and comprising:

(i) a first traveling belt forming a first contact point with a traveling strand of fibers imparting a first false twisting thereto, and (ii) a second traveling belt forming a second contact point with said traveling strand of fibers imparting a second false twisting thereto, wherein said traveling strand of fibers is first running through said compact spinning device in a spinning triangle and then through said false twist device to be false twisted twice at said false twisting points; and wherein said first traveling belt and said second traveling belt are running at a substantially same speed but in opposite directions.

7. The apparatus of claim 6, wherein said compact spinning device is a suction drum.

8. The apparatus of claim 6, wherein said compact spinning device is a suction tube.

9. The apparatus of claim 6, wherein said compact spinning device is a mechanic block having a channel through which said traveling strand of fibers is passing through prior to entering said false twist device.

10. The apparatus of claim 6, wherein said first traveling belt and second traveling belt are part of a single endless belt.

11. The apparatus of claim 6, wherein said first and said second travelling belts operate at a speed of between 6-68 m/min.

12. The apparatus of claim 6, wherein said first and said second travelling belts and said travelling strand of fibers operate at a speed ratio of between 0.3-3.4 spinning to false twisting.

13. The apparatus of claim 6, wherein said first and said second travelling belts and said travelling strand of fibers form a wrapping angle of between 15-60 degree.

14. The apparatus of claim 6, wherein said compact spinning device is a mechanic block separating said travelling strand of fibers into two or multiple sub-strands in the spinning triangle.

15. The apparatus of claim 6, wherein said first and second travelling belts have a cross-sectional profile selected from the group consisting of a round shape, a round shape having a hollow core, an elliptical shape, an elliptical shape having a hollow core, a shape having two round sides, a shape having two round sides and a hollow core, a shape having a round side, a shape having a round side and a hollow core, a shape having rounded corners, and a shape having rounded corners and a hollow core.

16. The apparatus of claim 6, wherein said compact spinning device comprises a pressure adjusting component for gripping said travelling strand of fibers running through a drafting zone before running through said compact spinning device.

17. The apparatus of claim 16, wherein said pressure adjustment component is formed at two front rollers within said compact spinning device.

18. The apparatus of claim 8, wherein said suction tube applies negative air suction in the spinning triangle.

* * * * *